US005358769A

United States Patent [19]

Pechhold

[11] Patent Number: 5,358,769

[45] Date of Patent: Oct. 25, 1994

[54] PROCESS PROVIDING DURABLE STAIN-RESISTANCE BY USE OF MALEIC ANHYDRIDE POLYMERS

[75] Inventor: Engelbert Pechhold, Chadds Ford, Pa.

[73] Assignee: E. I. Du Pont de Nemours and Company, Wilmington, Del.

[21] Appl. No.: 12,792

[22] Filed: Feb. 2, 1993

[51] Int. Cl.[5] ..... B32B 3/02

[52] U.S. Cl. ..... 428/96; 8/115.56; 427/386; 427/393.4; 428/267

[58] Field of Search ..... 8/115.6, 115.56; 252/8.6; 427/386, 389.9, 393.4; 428/96, 267

[56] References Cited

U.S. PATENT DOCUMENTS

| | | | |
|---|---|---|---|
| 4,081,383 | 3/1978 | Warburton et al. | 252/8.6 |
| 4,822,373 | 4/1989 | Olson et al. | 8/115.6 |
| 5,032,136 | 7/1991 | Fitzgerald et al. | 8/115.6 |

*Primary Examiner*—Michael Lusignan
*Attorney, Agent, or Firm*—Charles E. Feeny

[57] ABSTRACT

Processes and compositions which at the same time impart resistance to staining of polyamide substrates caused by acid dyes and improved durability to shampooing and resistance to yellowing caused by exposure to UV and/or $NO_x$, whereby the stain-resist performance of hydrolyzed maleic anhydride copolymers can be dramatically improved either by co-applying the stain with a water-dispersed epoxy resin or by post-treatment of the stain-resist-treated polyamide fiber substrate with a water-dispersed epoxy resin.

11 Claims, No Drawings

PROCESS PROVIDING DURABLE STAIN-RESISTANCE BY USE OF MALEIC ANHYDRIDE POLYMERS

FIELD OF THE INVENTION

The present invention relates to novel processes and compositions for imparting more durable stain-resistance to polyamide fiber substrates.

BACKGROUND OF THE INVENTION

It is well-known to treat polyamide substrates, such as catering, with compositions which impart resistance to staining by an acid dye, such as FD&C Red Dye No. 40. Such compositions are commonly referred to as stain-resists or stainresist agents.

For example, one class of known stain-resist agents comprises one or more sulfonated hydroaromatic-formaldehyde condensation products, for example, phenol-formaldehyde condensation products or formaldehyde-naphthol condensates. When stain-resist agents based on such condensation products are applied to polyamide substrates, they provide acid dye stain-resistance which resists removal by shampooing. But such treated substrates are prone to yellowing on exposure to ultraviolet light (UV) or to nitrogen oxides (NOx), or to combinations of UV and NOx exposure.

Another class of known stain-resists involves the use of hydrolyzed copolymers derived from maleic arthydride and ethylenically unsaturated compounds. Examples include hydrolyzed copolymers of realere anhydride and one or more of the following comohomers: ethylenically unsaturated aromatics, alphaolefins, alkyl vinyl ethers, and alkyl allyl ethers. Due to the ionic character of stainresist agents based on hydrolyzed maleic anhydride copolymers, polyamide fiber substrates treated with such stain-resists tend to be sensitive to high pH values, such as those that may often be encountered in commercial rug shampoos. As a result, in some cases, stain-resistance is partially or completely lost following shampooing. Such stain-resist agents show better resistance to yellowing on exposure to UV or NOx or a combination of UV and NOx, but poorer resistance to removal by shampooing than the sulfonated phenol-formaldehyde condensates.

Epoxy resins can be cured with carboxylic or polycarboxylic acids, and epoxy resins in combination with carbonlie acid-containing polymers can be applied to fiber substrates. For example, combinations of epoxy resins and copolymers of metbacklit acid have been applied to carpets and carpet yarns as anti-soilants for carpets and carpet yarns.

In view of the above-described considerations, it is apparent that there is a need to provide stain-resists for polyamide substrates which combine resistance to removal during commercial shampooing and resistance to yellowing caused by UV or $NO_x$ or both.

BRIEF SUMMARY OF THE INVENTION

The present invention provides compositions and processes of using them which at the same time impart resistance to staining of polyamide substrates caused by acid dyes and improved durability to shampooing and resistance to yellowing caused by exposure to UV and/or $NO_x$. It has been found in accordance with the present invention that the stain-resist performance of hydrolyzed maleic anhydride copolymers can be dramatically improved either by co-applying the stainresist with a water-dispersed epoxy resin or by post-treatment of the stain-resist-treated polyamide fiber substrate with a water-dispersed epoxy resin. It appears that crosslinking with the epoxy resin locks the stain-resist in or onto the fiber and thus prevents excessive dissolution during alkaline shampoo treatment. The epoxy resin itself neither contributes to stain-resistance nor does it appear to be exhausted onto the polyamide fiber. It is essential to avoid any reaction of the epoxy resin and the stain-resist prior to their being applied to the polyamide substrate, because such a reaction product will not be capable of imparting stain-resistance to polyamide substrates.

DETAILED DESCRIPTION OF THE INVENTION

Shampoo treatments typically utilize aqueous surfactant solutions with pH values of about 10. Such treatments remove part or all of stain-resist agents based on hydrolyzed maleic anhydride copolymers. The current invention provides a means to render the stain-resist agents less soluble by crosslinking the stain-resist agent so that the stain-resist properties of a stain-resist-treated polyamide substrate are retained to a greater extent after the treated substrate has been shampooed. The present invention provides a method of combining epoxy resins with polymeric stain-resists based on hydrolyzed copolymers of maleic anhydride with either o ethylenically unsaturated aromatics, alpha-olefins, alkyl vinyl ethers or alkyl allyl ethers, which greatly improves shampoo resistance without introducing yellowing instability to UV and NOx exposures.

The present invention relates to novel compositions for imparting more durable stain-resistance to polyamide fiber substrates comprising blends of epoxy resins with polymeric stain-resists consisting essentially of hydrolyzed copolymers of maleic anhydride with ethylenically unsaturated aromatics, alphaolefins, alkyl vinyl ethers or alkyl allyl ethers. This invention relates also to processes for imparting resistance to staining of polyamide substrates caused by acid dyes which consists essentially of (1) applying to said substrates (A) epoxy resins and (B) hydrolyzed copolymers of maleic anhydride and ethylenically unsaturated aromatics, alpha-olefins, alkyl vinyl ethers or alkyl allyl ethers, and (2) heating the so-treated substrate is to an elevated temperature sufficient to effect reaction between the epoxy resins and the hydrolized maleic arthydride copolymers. Such temperatures will be apparent to those skilled in the art from observation of to such reactions. The present invention relates also to resulting polyamide substrates having the epoxy resins and the hydrolyzed maleic anhydride copolymers reacted on them at said elevated temperatures.

In a preferred embodiment, the hydrolyzed maleic anhydride copolymer and the epoxy resin are applied to the polyamide substrate as an aqueous blend. Thus, for example, one can use an application technique which uses the least amount of water, e.g. by padding, Kuster/knife roll, or print roll application. While use of the foregoing application technique involving the use of the least amount of water is preferred, in the alternative, one can use a technique in which the blend is applied at a higher liquor-to-goods ratio, e.g. by flex-nip application. In another embodiment, one can use any of the foregoing techniques to first apply the hydrolyzed maleic anhydride copolymer stain-resist to the polyamide substrate, and to thereafter apply the epoxy resin the substrate. The polymeric stain-resist and the epoxy resin are usually applied at temperatures in the range between 20° and 60° C. The treated polyamide fiber substrate can then be dried and cured with dry heat, or steam-cured and dried, at elevated temperatures in the range between 50° and 200° C. for periods of one minute to one hour, thereby providing a polyamide fiber substrate on which the epoxy resins and the hydrolized maleic anhydride copolymer have been reacted at said elevated temperatures.

The amounts of the hydrolyzed maleic anhydride polymeric stainresists and the epoxy resins to be applied to the polyamide substrates can be determined by observation. Thus the minimum amounts of each are those which are sufficient provide the polyamide substrates with durable resistance to straining by acid dyes. Obviously, amounts in excess of those needed to effect optimum stainresistance are uneconomical, but they are undesirable for yet another reason. Excessive amounts will stiffen the substrates; indeed, such amounts will adversely affect the "hand" of a polyamide fibous substrate. For example, one can use between 0.3 and 2% by weight of the hydrolyzed maleic anhydride copolymer stainresist, based on the weight of the polyamide substrate, and amount of the epoxy resin needed to improve performance may range between 5 and 100% of the weight of stain-resist, preferably between 10 and 50%. The hydrolyzed maleic anhydride copolymer stainresist agents of this invention show poor resistance to high pH values, specifically the pH values of about 10 found in commercial shampoo formulations. To be effective, the stain-resist agents should be applied at pH values below 4.0, preferably between 2.0 to 2.5. The carboxylic acid-containing stain-resist agents of this invention can be applied in combination with sulfonated phenol/formaldehyde condensates, such as those described in U.S. Pat. Nos. 4,948,650, 4,879,180, 4,865,885, 4,839212, 4,822,373.4,789,099, and 4,592,940.

The epoxy resins useful for the purposes of this invention are substantially diverse in nature. The water-dispersible epoxy resins useful for the purposes of this invention include any water-soluble or emulsifiable epoxy compounds containing two or more epoxy groups. Generally, these are resins of up to about 800 epoxy equivalent weight, preferably up to about 200, which may be saturated or unsaturated, aliphatic, cycloaliphatic, aromatic or heterocyclic. Such resins include epoxidized triglycerides, epoxy polyethers of polyhydric alcohols and phenols, glycidyl ethers of resins obtained by condensing an aidehyde with a polyhydric phenol, reaction products of polyhydric alcohols or phenols with a polyepoxide, polymers and copolymers of epoxy-containing monomers having at least one polymerizable ethylenic linkage, and epoxy esters of polybasic acids, including aliphatic diglycidyl ethers within the scope of Formula I below, such as ethylene glycol diglycidyl ether, propylene glycol diglycidyl ether, and trimethylene glycol diglycidyl ether. Related water-soluble or readily water-dispersible glycidyl ethers that may be used are the polyglycidyl ethers of polyhydric alcohols having two to four carbon atoms, such as of ethylene glycol, glycerol, trimethylene glycol, propylene glycol, butylene glycols, their dimers, trimers, and higher polymers and especially the water-soluble or water-dispersible glycidyl ethers having the structure of one of Formulas I, II and III.

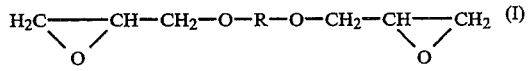

(I)

wherein R is an alkylene group of from two to six carbon atoms;

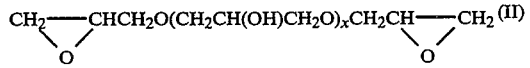

(II)

wherein x is a number having an average value of one to three;

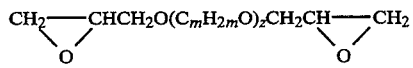

(III)

wherein m is an integer having a value of two to four, and z is a number having an average value of one to five. All of these polyepoxides contain at least two vic-epoxy groups in which the epoxy oxygen atom is attached to adjacent carbon atoms and have molecular weights of about 160–1000. The glycidyl ethers may preferably have molecular weights of about 180 to 400. Other examples of epoxy resins are described in the article on epoxy resins, Kirk-Othmer, Encyclopedia of Chemical Technology, 2nd Edition, Vol. 8, pages 294–312, John Wiley and Sons, Inc. New York (1965).

However, for sake of convenience and economy, one should generally use commercial epoxy resins based on Bisphenol A, novolacs, epichlorohydrin, glycidyl acrylate, glycidyl methacrylate or related materials. In addition to those described in the Examples herein which follow, see, for example, those described by Shell Chemical Company in "Epikote Technical Manual EP 2.5 2nd edition" (T2408/8.81/1000), "Formulation Notes" (EMULS-1 06/06/90), and "Specification Guide" (SC 21-90, 8/90), as well as those described by CIBA-GEIGY in "Resins and ltardeners Product Guide" (1990 CR1053BSM70). Epoxy resins based on Bisphenol A and epichlorohydrin are preferred, with "Custom Solution 287" water-dispersible Bisphenol A-epichlorohydrin-based epoxy resin being most preferred.

A dispersing agent such as polyvinylalcohol, a polyoxyethylene sorbitan monolaurate, or an octylphenoxypolyethoxyethanol may be employed to aid in the dispersion of those epoxy compounds which are not readily water-soluble. Their solubility in aqueous systems may also be improved by the addition of a lower alcohol, such as ethanol, isopropanol, and the like. Such methods of improving dispersibility are well known. alcohol, such as ethanol, isopropanol, and the like. Such methods of improving dispersibility are well known.

A variety of ethylenically unsaturated aromatic compounds can be used for the purpose of preparing the hydrolyzed polymers of this invention. Those aromatic compounds can be represented by the formula:

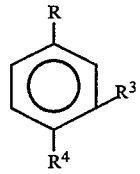

-continued wherein

R is $R^1-CH=\overset{R^2}{\overset{|}{C}}-$ or $CH_2=CH-CH_2$;

$R^1$ is H—, $CH_3$— or 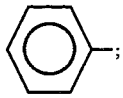 —;

$R^2$ is H— or $CH_3$—;

$R^3$ is H— or $CH_3O$—;

$R^4$ is H—, $CH_3$—, or $CH_3\overset{O}{\overset{//}{C}}O$—, and $R^3$ plus $R^4$ is —O—$CH_2$—O—.

Specific examples of ethylenically unsaturated aromatic compounds suitable for the purposes of this invention include styrene, alpha-methylstyrene, 4-methyl styrene, stilbene, 4-acetoxystilbene (used to prepare a hydrolyzed polymer from maleic anhydride and 4-hydroxystilbene), eugenol acetate, isoeugenol acetate, 4-allylphenol acetate, safrole, mixtures of the same, and the like. From the standpoint of cost-effectiveness, a copolymer prepared from styrene and maleic anhydride at a 1:1 molar ratio is preferred. The hydrolyzed polymers can have molecular weights (number average) in the range between about 500 and 4000, preferably between about 800 and 2000. They are readily soluble, even at high concentrations, in water at neutral to alkaline pit; increasing dilution is needed at a pH below 6. Such copolymers and their preparation are disclosed in U.S. Pat. No. 5,001,004, the contents of which are incorporated herein by reference.

Similarly, a number of allyl ethers and vinyl ethers can be used for the purposes of this invention. Particularly useful ethers include those which can be represented by the formula:

$$CH_2=CH-(CH_2)_k-O-(CH_2)_m-(A)_n-R$$

wherein

R is hydrogen or an alkyl radical containing 4 to 8 carbon atoms, or 2,3-epoxypropyl, or an alicyclic hydrocarbon radical containing 6 to 12 carbon atoms, or an aromatic hydrocarbon radical containing 6 to 12 carbon atoms, or a perfluoroalkyl radical containing 3 to 16 carbon atoms, preferably 6 to 12, and which may contain a terminal —$CF_2H$ group;

A is a divalent radical —$SO2R^1$— or —$CONR^1$— in which $R^1$ is hydrogen or an alkyl radical containing 1 to 6 carbon atoms;

k is 0 or 1;

m is 0 or 2; and n is 0 or 1.

Particular examples include n-butyl vinyl ether, isobutyl vinyl ether, iso-octyl vinyl ether, 2-perfluorohexylethyl vinyl ether, allyl n-butyl ether, allyl phenyl ether, allyl glycidyl ether, and the like. The foregoing polymers and their preparation are described in U.S. application Ser. No. 07/962,156 filed 15 October 1992, the contents of which are incorporated herein by reference.

Likewise, various linear and branched chain alpha-olefins can be used for the purposes of this invention. Particularly useful alpha-olefins include dienes containing 4 to 18 carbon atoms, such as butadiene, chloroprene, isoprene, and 2-methyl-1,5-hexadiene; preferably 1-alkenes containing 4 to 8 carbon atoms, such as isobutylene, 1-butene, 1-hexene, 1-octene, and the like, with isobutylene being most preferred. A part of the alpha-olefins can be replaced by other monomers, e.g. up to 50 wt% of alkyl($C_{1-4}$) acrylates, alkyl($C_{1-4}$) methacrylates, vinyl acetate, vinyl chloride, vinylidine chloride, vinyl sulfides, N-vinyl pyrrolidone, acrylonitrile, acrylamide, as well as mixtures of the same. A part (1–75%) of the maleic anhydride can be replaced by maleimide, N-alkyl($C_{1-4}$) maleimides, N-phenyl-maleimide, fumaric acid, itaconic acid, citraconic acid, aeontic acid, crotonic acid, cinnamic acid, alkyl($C_{1-18}$) esters of the foregoing acids, cycloalkyl($C_{3-8}$) esters of the foregoing acids, sulfated castor oil, or the like. At least 95 wt% of the maleic anhydride co- or terpolymers have a number average molecular weight of in the range between about 700 and 200,000, preferably between about 1000 and 100,000. The foregoing polymers and their preparation are described in U.S. application Ser. No. 07/809,843 filed 18 December 1992, the contents of which are incorporated herein by reference.

In the Examples that follow, the following carboxylic acid polymers were tested on nylon carpets:

1. "SMA-1000" Styrene Maleic Arthydride Copolymer (Atochem Inc.).
2. "Isobam-01" Isobutylene-Maleic Anhydride Copolymer (Kuraray Co.) having a number average molecular weigh of 10,000.
3. N-Butyl Vinyl Ether-Maleic Anhydride Copolymer prepared according to Example 1 of my Application Serial No. 07/634,794 filed 27 December 1990.

The following epoxy resins were tested on carpets:

1. "MS 9772" Emulsion of novolac-epichlorohydrin based epoxy resin (2,4 & 2,6 dimethylene phenol glycidyl ether polymer) sold by Ciba-Geigy.
2. "Custom Solution 287" Water dispersible hisphenol A- epichlorohydrin based epoxy resin (Shell Chemical)
3. "Epon 828" Bisphenol A-epichlorohydrin based epoxy resin, epoxy equivalent: 193–203 (Shell Chemical)
4. "Eponex 15 10" Hydrogenated hisphenol A-epichlorohydrin based epoxy resin, epoxy equivalent: 232–238 (Shell Chemical)
5. "Epon Resin 1001 F" Bisphenol A-epichlorohydrin based epoxy resin, epoxy equivalent weight: 525–550 (Shell Chemical)

The epoxy resins were dispersed in water by using dispersion procedures which are well-known in their fields of manufacture and formulation, e.g. techniques described by Shell Chemical Company in "Epikote Technical Manual EP 2.5 2nd edition" (T2408/8.81/1000) and in "Formulation Notes" (EMULS-1 06/06/90).

TEST METHODS

The following test methods were used to evaluate the carpet:

1. Stain Test

A nylon polyamide carpet specimen (3×5 inch) is placed on a flat nonabsorbent surface. Twenty ml of a red dye solution consisting of 0.2 g FD&C Red 40 and 3.2 g citric acid in 1 liter of deionized water is poured into a 2-inch diameter cylinder which is placed tightly over the specimen. The cylinder is removed after all the red dye solution has been absorbed. The stained carpet specimen is left undisturbed for 24 hours, after which it is rinsed thoroughly under cold tap water and squeezed dry. The specimens are visually inspected and the amount of color remaining in the stained area rated according to the following stain rating scale:

5=no staining
4=slight staining
3=noticeable staining
2=considerable staining
1=heavy staining A stain rating of 5 is excellent, showing outstanding stain-resistance, whereas 1 is the worst rating, comparable to an untreated control sample.

2. Shampoo-Wash Durability Test

A 3×5 inch nylon carpet specimen is submerged for 5 minutes at room temperature in a detergent solution consisting of sodium lauryl sulfate (dodecyl sodium sulfate) such as "Duponol WAQE" (1.5 g per liter) and adjusted with dilute sodium carbonate to a pH of 10. The specimen is then removed, rinsed thoroughly under tap water, de-watered by squeezing, and air-dried. The dry carpet specimen is then tested according to the Stain Test described above.

3. UV Lightfastness

The colorfastness to UV light was measured according to AATCC Test Method 16E-1987. Nylon carpet specimens were rated in accordance with the Grey Scale for color change after exposure to 40 AATCC Fading Units (AFU).

4. NOx Colorfastness

The colorfastness to oxides of nitrogen was carried out according to AATCC Test Method 164–1987. At the end of 2 cycles, nylon carpet specimens were rated for color change in accordance with the Grey Scale.

The following Examples are given way of illustration not limitation. Unless indicated otherwise, all parts and percentages are by weight and all temperatures are in degrees Celcius.

EXAMPLE 1

A 1/1 molar styrene/maleic anhydride copolymer having a number average molecular weight of 1600 (Atochem Inc. "SMA-1000" resin) was hydrolyzed with aqueous sodium hydroxide to a 25% concentration based on polymer. One thousand parts of the resulting solution were blended with 150 parts of a commercial alkylated disulfonated diphenyl oxide (Dow Chemical's "Dowfax 2A-4"), adjusted to a pH of 2.1–2.2 with sulfamic acid and diluted to a concentration of 0.72% based on "SMA-1000" resin. Three hundred and thirty four parts of the 0.72% "SMA-1000" solution were mixed at 50°–60° C. with 16 parts of an epoxide resin emulsion of any desired concentration. The test solutions were applied by padding onto 6×8 inch pieces of white level loop carpet. The thus treated carpets were dried for 30 minutes at 120° C. and tested in accordance with the Stain Test resulting the data given in TABLE I (loading of the chemicals, given as percent on the weight of fiber (% owf), was calculated from the measured wet-pick-up).

TABLE I

| "SMA-1000" | EPOXIDE RESIN (100%) | | RED DYE SOLUTION STAIN |
|---|---|---|---|
| % owf | TYPE | % owf | 24 HOURS |
| 0.51 | None | | 2 |
| 0.76 | None | | 2–3 |
| — | "MS 9772" | 0.5 | 1 |
| — | "Custom Solution" | 0.54 | 1 |
| 0.63 | "MS 9772" | 0.63 | 4–5 |
| 0.38 | "MS 9772" | 0.38 | 4 |
| 0.73 | "Custom Solution" | 0.73 | 5 |
| 0.60 | "Custom Solution" | 0.4 | 5 |
| 0.38 | "Custom Solution" | 0.38 | 4–5 |
| 0.50 | "Epon 828" | 0.33 | 4 |
| 0.46 | "Eponex 1510" | 0.31 | 3 |
| 0.46 | "Epon 1001 F" | 0.31 | 2–3 |

EXAMPLE 2

An isobutylene/maleic anhydride copolymer commercially available from Kuraray Co.(Japan) as "Isobam-01" and a low molecular copolymer of n-butyl vinyl ether with maleic anhydride were hydrolyzed with aqueous sodium hydroxide and adjusted to a 25% concentration based on polymer. One thousand parts of each of these solutions were adjusted to a pH of 2.1–2.2 with sulfamic acid and diluted to a concentration of 0.72% based on the maleic anhydride copolymer. Addition of 150 parts of "Dowfax 2A-4" was necessary as in Example 1 for the n-butyl vinyl ether/maleic acid copolymer before pH adjustment. Three hundred and thirty-four parts of the 0.72% maleic acid copolymer solutions were mixed at 50–60 deg. C. with 16 parts of an emulsion of "Epon Custom Solution 287" of any desired concentration. The test solutions were applied by padding onto 6x8 inch pieces of white level loop nylon 6/6 carpet. The thus-treated carpets were dried for 30 minutes at 120 deg. C. and tested for 24 hour Red Dye stain (Test Method 1). The actual loading of the chemicals is expressed as percent on the weight of fiber (% owf) was calculated from the measured wet-pick-up. Test results are shown below in Table II.

TABLE II

| MALEIC ANHYDRIDE TYPE | COPOLYMER % owf | CUSTOM SOLUTION 287 % owf | RED DYE STAIN 24 HOURS |
|---|---|---|---|
| Isobutylene | 0.63 | No | 1–2 |
| Isobutylene | 0.66 | 0.47 | 5 |
| Butyl Vinyl Ether | 0.63 | No | 2 |
| Butyl Vinyl Ether | 0.65 | 0.47 | 4 |

EXAMPLE 3

In another mode of application, the styrene-maleic acid based stain resist described in Example 1 was applied by exhaust at pH 2.15 in a Launder-0-Meter. A part of the thus treated carpet was padded with Shell's "Custom Solution 287" epoxide resin, dried and tested against the control as shown in Table III.

TABLE III

| "SMA-1000" | EPOXIDE | RED DYE SOLUTION STAINING (24 HRS) | |
|---|---|---|---|
| Exhausted % owf | PADDED % owf | INITIAL | AFTER SHAMPOOING |
| 0.44 | No | 4–5 | 2–3 |
| 0.44 | 0.28 | 5 | 5 |

EXAMPLE 4

Blends of styrene-maleic acid stain-resist "SMA-1000" with Shell's epoxide "Custom Solution 287" were vertical pad applied at pH 2.1–2.2 onto blue cut pile carpet using semi-commercial equipment. The thus treated carpet was then steamed, washed, extracted, and finally dried. After latexing the carpet was tested for stain-resistance before and after shampooing as shown below in Table IV.

TABLE IV

| "SMA-1000" % owf | "CUSTOM SOLUTION" % owf | RED DYE SOLUTION STAINING (24 HRS) INITIAL | AFTER SHAMPOOING |
|---|---|---|---|
| 1.36 | No | 4–5 | 2 |
| 1.19 | No | 3 | 1 |
| 0.9 | 0.1 | 5 | 1–2 |
| 0.8 | 0.2 | 5 | 4 |
| 1.06 | 0.26 | 5 | 4 |
| 2.0 | 1.0 | 5 | 5 |

EXAMPLE 5

The lightfastness and NOx colorfastness (Test Methods 3 and 4) of white level loop carpet treated according to the method described in Example 1, was determined according to the lightfastness and colorfastness tests described earlier. The results are shown below in Table V.

TABLE V

| "SMA-1000" % owf | "CUSTOM SOLUTION" % owf | XENON 40 AFU | NOx 2-CYCLES |
|---|---|---|---|
| 0.5 | No | 5 | 5 |
| 0.78 | 0.78 | 5 | 4–5 |
| 0.59 | 0.39 | 5 | 5 |

I claim:

1. A process for imparting to polyamide substrates resistance to staining by acid dyes, which resistance is durable to shampooing, comprising applying (A) one or more epoxy resins and (B) a polymeric stain-resist consisting essentially of one or more hydrolyzed copolymers of maleic anhydride and one or more ethylenically unsaturated aromatics, 1-alkenes containing 4 to 8 carbon atoms, alkyl vinyl ethers, or alkyl allyl ethers.

2. The process of claim 1 comprising applying to said substrate one or more of said polymeric stain-resist agents, and thereafter applying one or more of said epoxy resins to said substrate.

3. The process of either claim 1 or 2 wherein said polymeric stain-resist agent comprises a hydrolyzed copolymer of maleic anhydride and at least one ethylenically unsaturated aromatic.

4. The process of either claim 1 or 2 wherein said epoxy resin is a novolacepichlorohydrin resin.

5. The process of either claim 1 or 2 wherein said epoxy resin is a bisphenol A-epichlorohydrin resin.

6. The process of either claim 1 or 2 wherein said epoxy resin is a hydrogenated bisphenol A-epichlorohydrin resin.

7. The process of claim 3 wherein said ethylenically unsaturated aromatic is styrene.

8. The process of claim 3 wherein said ethylenically unsaturated aromatic is isobutylene.

9. The process of any of claims 1, 3, 4, 5, 6, 7, or 8 wherein said epoxy resins and said polymeric stain-resist agents are applied as a blend.

10. A polyamide substrate prepared in accordance with the process of claim 9, which substrate has resistance to staining by acid dyes which is durable to shampooing.

11. A polyamide substrate prepared in accordance with the process of claim 2, which substrate has resistance to staining by acid dyes which is durable to shampooing.

* * * * *